US009573295B2

(12) United States Patent
Johnson et al.

(10) Patent No.: US 9,573,295 B2
(45) Date of Patent: Feb. 21, 2017

(54) CUTTING TOOL, MOUNTING BRACKET, AND ROTATABLE CUTTING HEAD

(71) Applicant: SURFACE PREPARATION TECHNOLOGIES, LLC, Mechanicsburg, PA (US)

(72) Inventors: H. Matthew Johnson, Shermansdale, PA (US); Jeffrey M. Dows, Mechanicsburg, PA (US)

(73) Assignee: SURFACE PREPARATION TECHNOLOGIES, LLC, Mechanicsburg, PA (US)

( * ) Notice: Subject to any disclaimer, the term of this patent is extended or adjusted under 35 U.S.C. 154(b) by 0 days.

(21) Appl. No.: 14/268,014

(22) Filed: May 2, 2014

(65) Prior Publication Data

US 2014/0327294 A1 Nov. 6, 2014

Related U.S. Application Data

(60) Provisional application No. 61/818,740, filed on May 2, 2013.

(51) Int. Cl.

| | |
|---|---|
| ***E21C 35/18*** | (2006.01) |
| ***B28D 1/18*** | (2006.01) |
| ***E01C 23/09*** | (2006.01) |

(52) U.S. Cl.

CPC ..... *B28D 1/186* (2013.01); *E01C 23/0946* (2013.01)

(58) Field of Classification Search

CPC ..... E21C 35/1936; E21C 27/44; E21C 2035/1809; B28D 1/186

USPC ..... 299/101

See application file for complete search history.

(56) References Cited

U.S. PATENT DOCUMENTS

| | | | | |
|---|---|---|---|---|
| 2,521,089 | A * | 9/1950 | Phipps | 299/112 R |
| 3,720,273 | A * | 3/1973 | McKenry et al. | 175/335 |
| 4,068,897 | A * | 1/1978 | Amoroso | 299/102 |
| 4,326,592 | A * | 4/1982 | Stephenson | A01B 33/103 172/123 |
| 4,674,802 | A * | 6/1987 | McKenna et al. | 299/112 R |
| 4,768,297 | A * | 9/1988 | Rivard | 37/91 |
| 5,101,583 | A * | 4/1992 | Scordilis | 37/91 |
| 5,904,408 | A * | 5/1999 | Olson | B28D 1/188 299/102 |

(Continued)

FOREIGN PATENT DOCUMENTS

| | | | | |
|---|---|---|---|---|
| DE | 3334268 A1 * | 4/1985 | ..... | E21C 27/32 |

*Primary Examiner* — John Kreck

(74) *Attorney, Agent, or Firm* — Spilman Thomas & Battle, P

(57) ABSTRACT

A cutting tool, a mounting bracket for the cutting tool, and a rotatable cutting head are provided. The cutting tool includes a saddle portion configured to be secured to a mounting bracket, an aperture extending through the saddle portion, and at least one cutting bit attachment portion. The mounting bracket includes a base having a receiving slot configured to receive a cutting tool, a threaded recess extending at least partially through the base, and a curved bottom surface corresponding to a curvature of a cutting drum. The rotatable cutting head comprises a drive shaft connectable to a drive motor, a drum portion coupled to the drive shaft, the drum portion having a curved outer surface, a plurality of mounting brackets secured to the curved outer surface, and at least one cutting tool having at least one cutting bit attachment portion removably secured to at least one of the mounting brackets.

15 Claims, 5 Drawing Sheets

(56) References Cited

U.S. PATENT DOCUMENTS

| | | | | |
|---|---|---|---|---|
| 7,475,949 | B2 * | 1/2009 | Helsel et al. | 299/108 |
| 8,870,297 | B2 * | 10/2014 | Pederson et al. | 299/39.4 |
| 2005/0098015 | A1 * | 5/2005 | Latham | E21C 35/1936 83/698.41 |
| 2009/0256413 | A1 * | 10/2009 | Majagi | B28D 1/188 299/100 |

* cited by examiner

CUTTING TOOL, MOUNTING BRACKET, AND ROTATABLE CUTTING HEAD

CROSS-REFERENCE TO RELATED APPLICATION

This application claims the benefit of and priority to U.S. Provisional Patent Application No. 61/818,740 entitled "Cutting Tool and Mounting Bracket for Rotatable Cutting Head" filed on May 2, 2013, which is hereby incorporated by reference in its entirety.

FIELD OF THE INVENTION

The application generally relates to an apparatus for cutting a groove in a pavement surface. The application relates more specifically to a cutting tool, a mounting bracket for the cutting tool, and a rotatable cutting head including the mounting bracket.

BACKGROUND OF THE INVENTION

Road surface markings are required on paved roadways to provide signals and information for road traffic. Stripes are typically painted on either side of the road and between traffic lanes to indicate the width of the traffic lanes in which the vehicle can travel. Visibility and uniformity of road markings is important to provide consistency and uncertainty for driver safety.

Road stripes may be applied by traditional line painting techniques such as spraying or rolling a painted line along the pavement surface. More recently, reflective tapes, high performance epoxy paints, and plastic pavement markings have been used on pavement surfaces to provide greater visibility and uniformity than painting techniques can provide. In either case, road stripes are exposed to the effects of traffic, tire wear and road maintenance equipment, e.g., snow plow blades.

Recently, road maintenance technology has advanced to provide reflective tape or paint into a shallow recess or groove in the pavement surface. The groove is preferably a precise depth and width, and having sharp corners. The groove may be discontinuous over a section of the pavement surface creating a broken line in the pavement surface for reflective paint or tape.

Conventional cutting drums include removable cutting bits that are attached to the cutting drum via dovetail configurations to prevent the cutting bits from becoming dislodged while performing road maintenance. Such cutting bits are removable by sliding the bit laterally from the dovetail groove. After the cutting bits have been used to cut pavement they are difficult to remove from the cutting drum due to the high temperature and dust which accumulates on the groove. Also, it is difficult to hammer the bits laterally because of the tight clearance between the cutting drum and the housing walls. Furthermore, a horizontal retention system restricts an amount of the cutting bits that can be affixed to the cutting drum, as it is necessary to provide lateral space between the cutting bits in order to change the cutting bits.

Intended advantages of the disclosed systems and/or methods satisfy one or more of these needs or provide other advantageous features. Other features and advantages will be made apparent from the present specification. The teachings disclosed extend to those embodiments that fall within the scope of the claims, regardless of whether they accomplish one or more of the aforementioned needs.

BRIEF DESCRIPTION OF THE INVENTION

In one embodiment, a cutting tool comprises a saddle portion, an aperture extending through the saddle portion, and at least one cutting bit attachment portion. The saddle portion is configured to be secured to a mounting bracket.

In another embodiment, a mounting bracket comprises a base having a receiving slot configured to receive a cutting tool, a threaded recess extending at least partially through the base, and a curved bottom surface. The curved bottom surface corresponds to a curvature of a cutting drum.

In yet another embodiment, a rotatable cutting head comprises a drive shaft connectable to a drive motor, a drum portion coupled to the drive shaft, the drum portion having a curved outer surface, a plurality of mounting brackets secured to the curved outer surface, and at least one cutting tool removably secured to at least one of the mounting brackets. The at least one cutting tool includes at least one cutting bit attachment portion.

Certain advantages of the embodiments described herein include an ability to vertically insert and remove a cutting tool from a mounting bracket, increased concentration of cutting teeth which provide a smoother cut at increased production speeds, decreased wear on cutting tools, decreased maintenance time between tooth replacements, decreased difficulty in replacing the conical cutting tooth and/or the flat-edged cutting tooth, or a combination thereof.

Alternative exemplary embodiments relate to other features and combinations of features as may be generally recited in the claims.

BRIEF DESCRIPTION OF THE DRAWINGS

Wherever possible, the same reference numbers will be used throughout the drawings to represent the same parts.

DETAILED DESCRIPTION OF THE INVENTION

Figure 1:
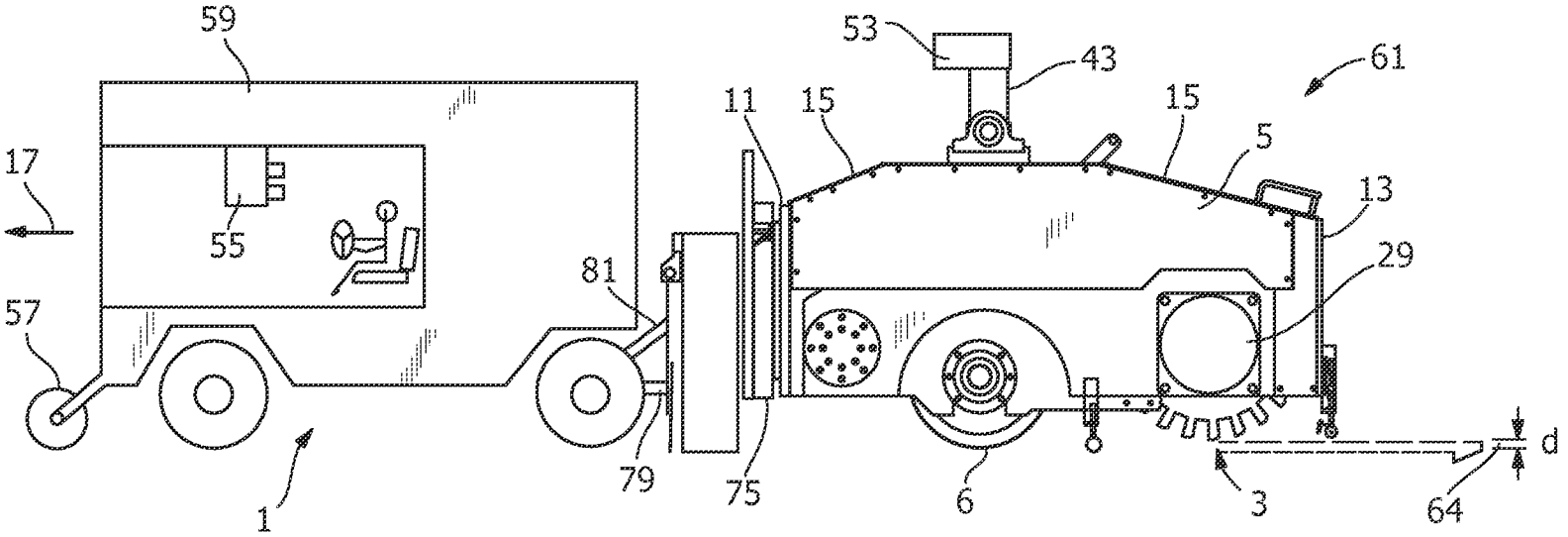
FIG. 1 is an elevational view of a cutting machine.
Figure 2:
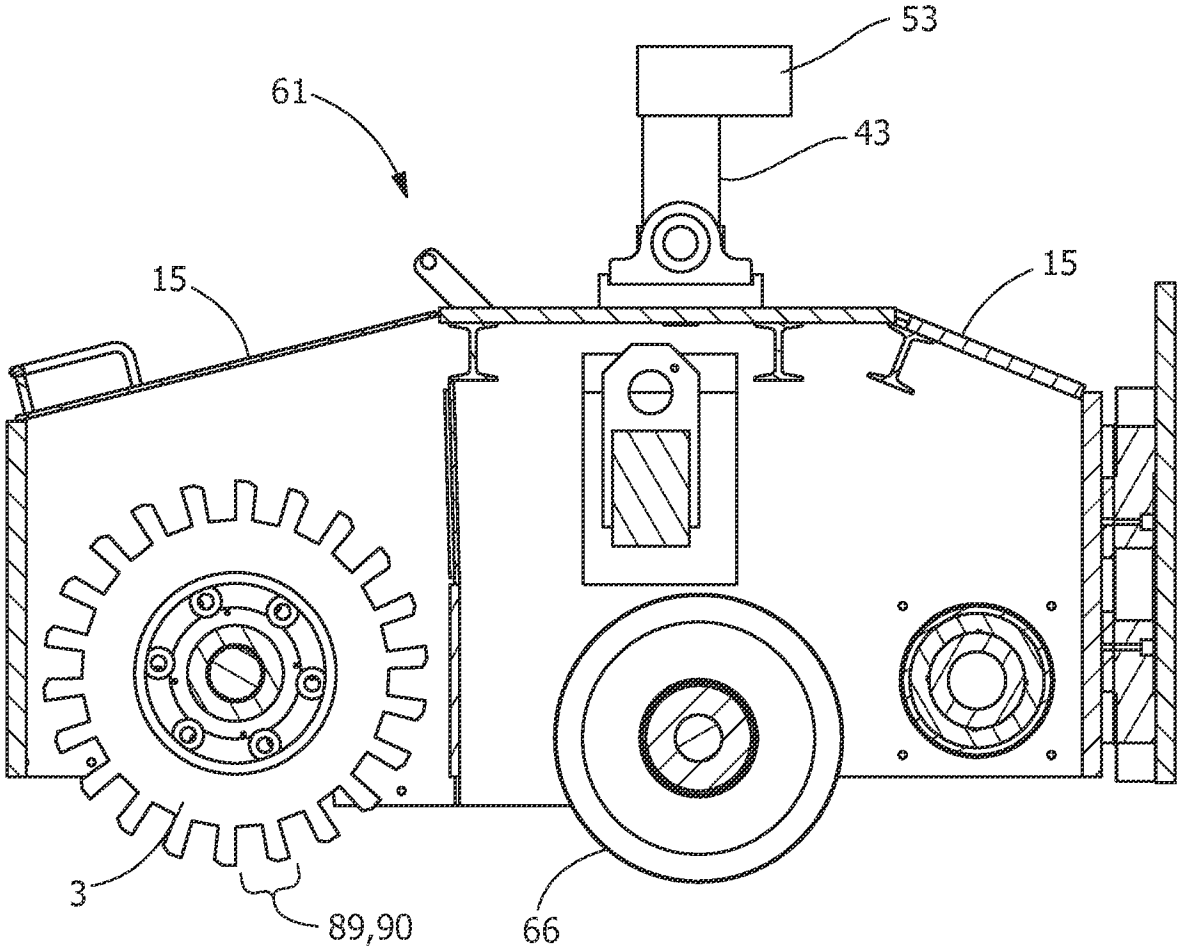
FIG. 2 is a plan view of a cutting apparatus showing the internal arrangement of the cutting drum and rollers.
Figure 3:
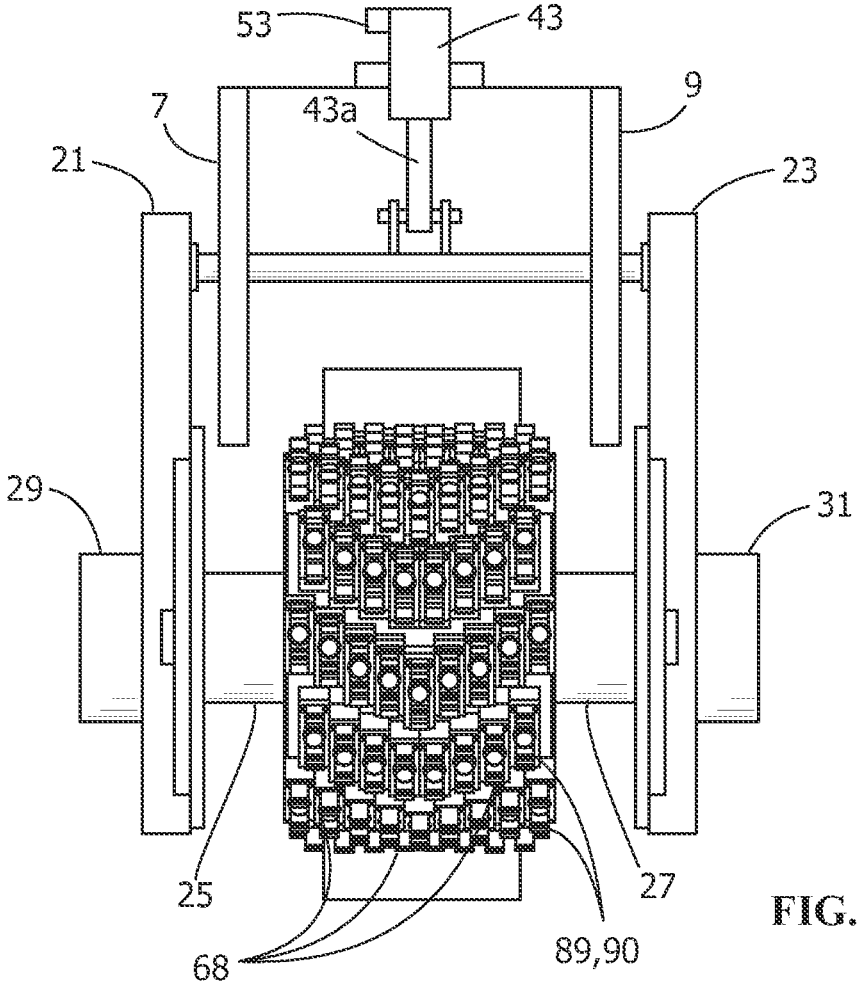
FIG. 3 is a front view of the cutting apparatus of FIG. 2 showing the internal arrangement of the cutting drum and rollers.

Referring to FIGS. 1-3, a cutting machine 1 includes a conventional cutting head/drum 3 contained within a drum housing 5 having a pair of opposed, substantially parallel, vertically extending side walls 7 and 9. In addition, drum housing 5 contains front and rear parallel sidewalls 11 and 13, and plates 15 forming part of the top of housing 5. The bottom of housing 5 is substantially open to permit drum 3 to extend therethrough. Drum 3 extending through the bottom of housing 5 provides cutting of a pavement surface 10, removal of existing pavement markings, or any other kind of pavement grinding. For example, as indicated by arrow 17, in one embodiment cutting machine 1 may travel in the forward direction towing drum housing 5 behind it as drum 3 cuts a groove 64 in the pavement surface 10. In an alternate embodiment cutting machine 1 may have drum housing 5 mounted on the front and push drum housing 5 in front of it as drum 3 cuts groove 64 into pavement surface 10. In another alternate embodiment, drum 3 may positioned on either or both sides of cutting machine 1.

Grooves 64 may be ground or milled into road pavement surface 10 to a depth d. The depth d may be any suitable depth for receiving road surface marking paint or tape, removing existing pavement markings, or any other pavement grinding. For example, in one embodiment, grooves 64 are ground or milled to a depth d of 50 mils for placement of road stripes for traffic lane marking, center lines, directional arrows, or other similar road markings. In another embodiment, machine 1 and drum 3 cut grooves 64 deeper or shallower than 50 mils, as desired. For example, the depth d of grooves 64 may be reduced to less than 50 mils for removal of existing pavement markings. The depth of any groove 64 may be automatically controlled to precise tolerances, e.g., plus or minus 10 mils.

The position of cutting drum 3 with respect to roller 6 depends on the direction of travel, i.e., whether cutting apparatus 61 is being towed behind power unit 59, as shown in FIG. 1, or whether cutting apparatus 61 is pushed in front of power unit 59. When performing surface maintenance operations, roller 6 precedes cutting drum 3 in the direction of travel. Thus the arrangement of cutting drum 3 and roller 6 in cutting apparatus 61 must be modified accordingly when cutting apparatus 61 is pushed in front of power unit 59. This may require an extension to housing 5 to accommodate a forward roller 6, as will be readily appreciated by those skilled in the art.

Referring to FIGS. 2-3, cutting drum 3 is carried within housing 5 by two arm plates 21 and 23 (FIG. 3). Cutting drum 3 is operably coupled, e.g., via splines, keyway or equivalent, to each of arm plates 21 and 23 through respective rotational drive units 25 and 27 which contain bearings therein. Drive units 25, 27 may include gear boxes, pulleys, chain sprockets, motors, and similar mechanical rotation units. Drive units 25 and 27 are each rigidly attached at one end thereof to the respective arm plate, which allows the opposite end of drive units 25 and 27 to rotate cutting drum 3. Cutting drum 3 is driven in a conventional manner by one or two prime movers 29, 31, i.e., hydraulic, electric or pneumatic motors, depending on torque and speed requirements. Prime movers 29, 31 are respectively mounted through arm plates 21 and 23 and into a respective drive unit 25 or 27. Cutting drum 3 is rotated in a counter clockwise/up cut direction relative to pavement surface 10.

The entire cutting tool apparatus 61 via housing 5, is attached to a mast 75 of power unit 59 by a slew-type bearing which allows cutting apparatus 61 to swivel horizontally. Housing 5 is supported in the center by a solid steel roller 6 which is affixed to a shaft 63 which is carried by two bearings 34 and 35. Bearings 34 and 35 are bolted to a roller housing assembly which is firmly attached to cutter housing 5.

Mast 75 is also attached to power unit 59 by lower hydraulic mast cylinders 79 and upper hydraulic mast cylinders 81 (two of each, only one shown) and control arms (not shown). The height of the rear of cutting tool apparatus 61 is adjusted by adjusting lower hydraulic mast cylinders 79. Once the height of the rear of cutting apparatus 61 is adjusted, lower hydraulic mast cylinders 79 are pressurized in a manner which continuously tries to retract the bottom of mast 75 toward power unit 59. This feature has the affect of transferring the weight of power unit 59 to cutting apparatus 61, and thereby continuously forces roller 6 into maintaining contact with pavement surface 10. Sufficient weight is required so that the cutting cycle can be completed without cutting apparatus 61 lifting up vertically.

It is desirable that cutting drum 3 be parallel to pavement surface 10 so that as piston 43*a* of hydraulic cylinder 43 extends, cutting drum 3 will extend evenly into pavement surface 10, forming an even depth across a width of groove 64. Maintaining an even extension of cutting drum 3 into pavement surface 10 assures a predetermined depth throughout groove 64. The predetermined depth of groove 64 is based upon the road markings to be placed in groove 64. An even predetermined depth throughout groove 64 forms a desired fit between the road markings and groove 64. The above-described leveling feature is self-adjusting so that the operation of cutting machine 1 can meet and maintain a maximum forward speed and a maximum production capability.

The cutting mechanism (cutting drum 3, arm plates 21, 23 and rotational drive units 25, 27) is raised and lowered by hydraulic cylinder 43 which is attached to plate 15 that forms part of the top of housing 5. In one embodiment, control of hydraulic cylinder 43 is accomplished via an electronic proportional valve 53. Electronic proportional valve 53 is activated to either raise or lower piston 43*a* of hydraulic cylinder 43 according to programmed instructions from a computer controller 55.

Figure 4:
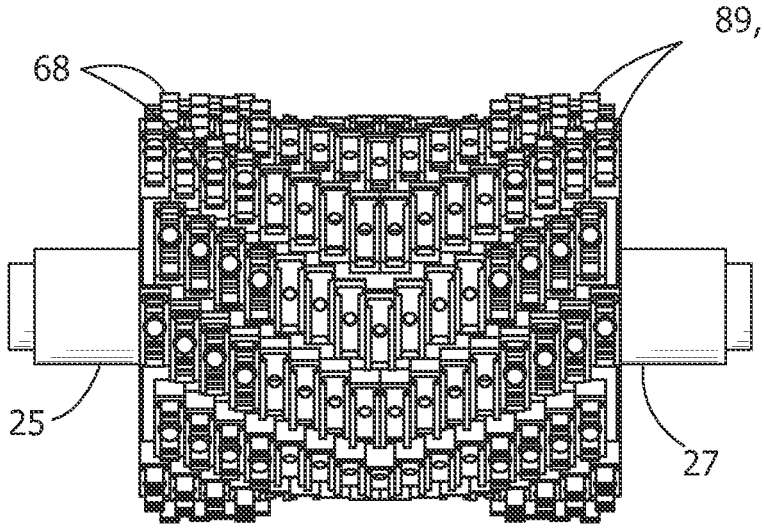
FIG. 4 is a front view of a cutting drum, according to an embodiment of the disclosure.

As shown in FIGS. 3 and 4, a plurality of mounting brackets 90 are secured to cutting drum 3. Each mounting bracket 90 includes a curved bottom surface corresponding to a curvature of cutting drum 3. In one embodiment, mounting brackets 90 are welded to cutting drum 3. For example, as shown in FIG. 3, the plurality of mounting brackets 90 are welded to cutting drum 3 in successive rows 68 having substantially "V" shaped profiles that alternate between one or two central mounting brackets 90. The alternating profiles provide an overlapping configuration of mounting brackets 90 in successive rows. Other embodiments include, but are not limited to, the plurality of mounting brackets 90 secured to cutting drum 3 in offset rows, the plurality of mounting brackets 90 secured to cutting drum 3 in overlapping rows, the plurality of mounting brackets 90 individually secured to cutting drum 3 in a predetermined pattern, or a combination thereof.

During operation, either a cutting tool 95 or a blank member is secured to each mounting bracket 90. Each cutting tool 95 includes one or more cutting members 89 such as, but not limited to, tungsten carbide tipped teeth, diamond cutting bits, other cutting teeth or bits of suitable hardness with which to grind away the pavement surface 10, or combinations thereof. Alternatively, the blank member includes an article without any cutting members 89, and serves as a placeholder to protect mounting bracket 90 during use. Cutting tools 95 secured to mounting brackets 90 in successive rows 68 generate a grinding pathway of cutting drum 3, while the blank members, when present, generate a non-grinding pathway. Additionally, when aligned, such as in every other successive row 68, cutting tools 95 provide support for each other to reduce wear and increase lifespan of cutting bits secured thereto.

When mounting brackets 90 are secured to cutting drum 3 in rows 68 having alternating profiles, cutting tools 95 in each successive row 68 cut a profile that partially overlaps the profile cut by cutting tools 95 in a preceding row 68. The partially overlapping profiles cut by cutting tools 95 secured to mounting brackets 90 in successive rows 68 provide complete or substantially complete grinding of pavement surface 10. The complete or substantially complete grinding of pavement surface 10 ensures a substantially level removal of pavement markings and/or a substantially level profile of the groove bottom.

Referring to FIGS. 5A-5B and 7A-7B, mounting brackets 90 each include a base 101 having a receiving slot 94 and a threaded recess 93 extending at least partially therethrough. Receiving slot 94 is defined by a pair of sidewalls 99 on either side of slot 94, base 101, and a rear wall 102 at one end of mounting bracket 90. In one embodiment, two lobes 103 are included on mounting bracket 90 to facilitate insertion and/or removal of a cutting tool 95. Lobes 103 refer to sections of base 101 where material has been removed to provide increased access to receiving slot 94. For example, lobes 103 provide access for a prying tool to facilitate removal of cutting tool 95 from receiving slot 94.

Figure 5A:
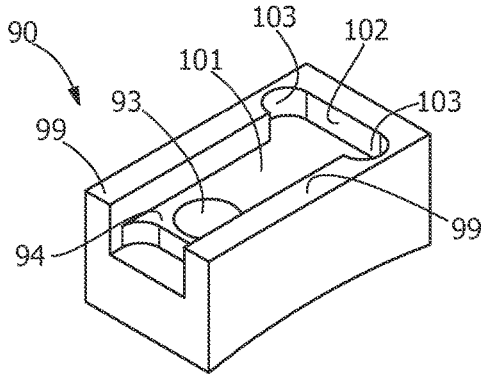
FIG. 5A is a perspective view of a mounting bracket, according to an embodiment of the disclosure.
Figure 7A:
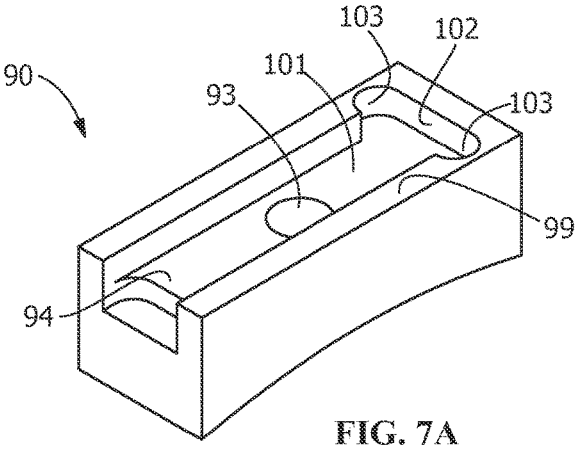
FIG. 7A is a perspective view of a mounting bracket, according to an embodiment of the disclosure.
Figure 5B:
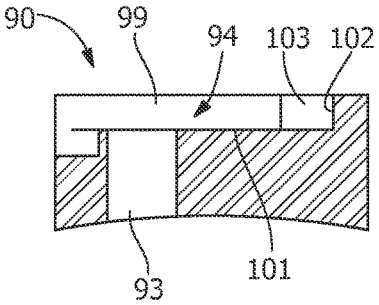
FIG. 5B is a sectional view of the mounting bracket of FIG. 5A.
Figure 7B:
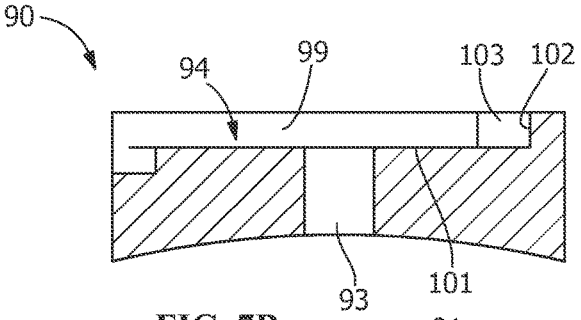
FIG. 7B is a sectional view of the mounting bracket of FIG. 7A.
Figure 6:
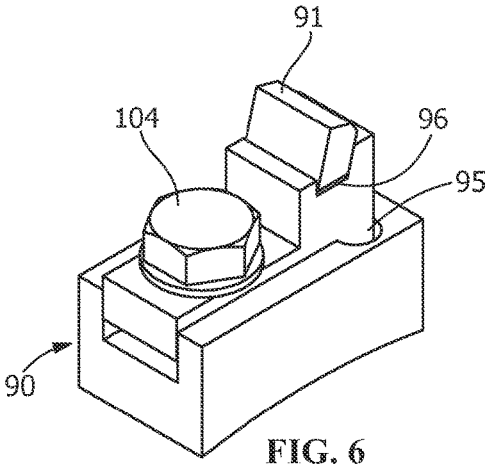
FIG. 6 is a perspective view of a cutting tool secured to the mounting bracket of FIG. 5A.
Figure 8:
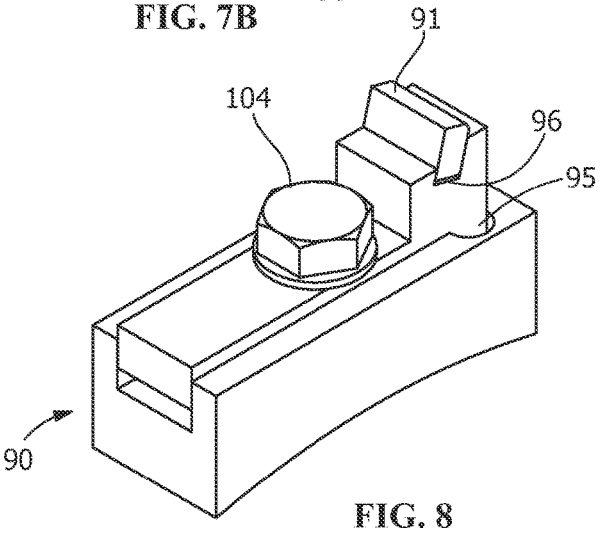
FIG. 8 is a perspective view of a cutting tool secured to the mounting bracket of FIG. 7A.
Figure 11:
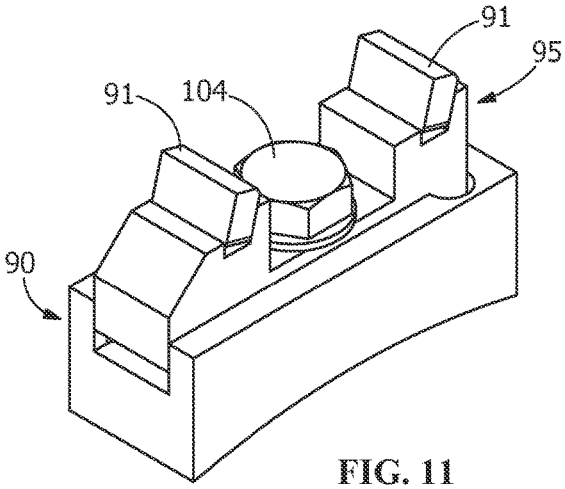
FIG. 11 is a perspective view of a cutting tool with two flat bits secured to the mounting bracket of FIG. 7A.

Referring to FIGS. 6, 8 and 11, cutting tool 95 is positioned within receiving slot 94 of mounting bracket 90 and secured thereto with a threaded member 104 or similar fastener. Threaded member 104 is inserted through an aperture 97 in cutting tool 95, and into threaded recess 93 to secure cutting tool 95 to mounting bracket 90. Threaded recess 93 is positioned in any suitable location within receiving slot 94. For example, as shown in FIGS. 5A-5B, threaded recess 93 is positioned at an end of receiving slot 94 distal from rear wall 102. Alternatively, as shown in FIGS. 7A-7B, threaded recess 93 is positioned centrally within receiving slot 94. The position of threaded recess 93 within receiving slot 94 may depend upon a length of mounting bracket 90, a configuration of cutting tool 95 to be secured thereto, or a combination thereof.

Figure 9:
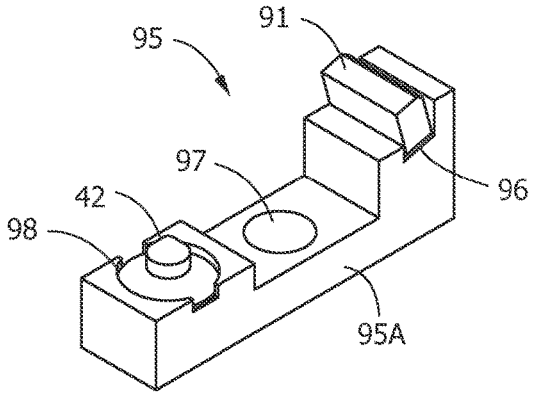
FIG. 9 is a perspective view of a cutting tool with a conical bit and a flat bit.
Figure 10:
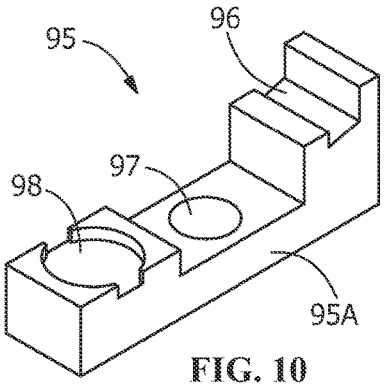
FIG. 10 is an alternate embodiment of the cutting tool of FIG. 9.
Figure 12:
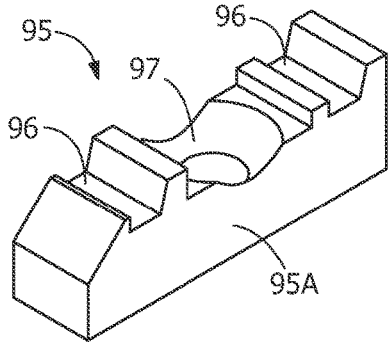
FIG. 12 is an alternate embodiment of the cutting tool shown in FIG. 11.

Referring to FIGS. 6 and 8-14, cutting tool 95 includes aperture 97 extending through a saddle portion 95A, and at least one cutting bit attachment section. The cutting bit attachment section includes at least one slot 96 for receiving a flat bit 91 and/or at least one generally circular recess 98 for receiving a conical bit 92 or flat bit 91. For example, as shown in FIGS. 6 and 8, cutting tool 95 includes a single slot 96 for receiving a single flat bit 91. In another example, as shown in FIGS. 9 and 10, cutting tool 95 includes a single slot 96 for receiving a single flat bit 91, and a single generally circular recess 98 for receiving a single conical bit 92. Alternatively, as shown in FIGS. 11-12, cutting tool 95 includes two slots 96, each slot 96 configured to receive a single flat bit 91. In yet another example, cutting tool 95 includes a single slot 96 and two generally circular recesses 98 (FIG. 13), two slot 96 and a single generally circular recess 98 (FIG. 14), or a combination thereof.

Each slot 96 and/or generally circular recess 98 includes a bottom portion and at least one wall portion. In one embodiment, the wall portion of generally circular recess 98 defines a shape of recess 98 corresponding to a shape of conical bit 92. In a further embodiment, as shown in FIG. 10, the wall portion of generally circular recess 98 includes features for receiving flat bit 91 therein, such that generally circular recess 98 is configured to receive either conical bit 92 or flat bit 91. In another embodiment, each slot 96 includes the bottom portion and at least two wall portions for receiving flat bit 91 therein. The bottom portion of each slot 96 is flat, inclined, or declined with respect to cutting tool 95. For example, slot 96 is shown with a declined bottom portion in FIG. 8, an inclined bottom portion in FIGS. 9-10, and a flat bottom portion in FIGS. 13-14. The two wall portions may be parallel, as shown in FIGS. 10 and 13-14, or divergent, as shown in FIGS. 11-12.

Bits 91, 92 and their associated slot 96 or recess 98 may be machined to provide a friction fit. Additionally or alternatively, bits 91, 92 may be welded, brazed or otherwise affixed to tool 95 to withstand the abrasive forces to which tool 95 encounters without dislodging the bits from tool 95. As will be readily appreciated by those skilled in the art, the number of slots 96 and/or recesses 98, the configuration of the slots 96 and/or recesses 98, and the attachment of the bits 91, 92 to cutting tool 95 disclosed in the embodiments above may be varied and/or combined based upon desired performance.

During operation of the cutting machine 1, cutting tools 95 secured to mounting brackets 90 on cutting drum 3 form groove 64 having predetermined width and depth. In one embodiment, cutting tool 95 is positioned within receiving slot 94 such that conical bit 92 contacts pavement surface 10 prior to flat bit 91. When pavement surface 10 is contacted by conical bit 92 first, the bulk of the pavement material is removed by conical bit 92, then flat bit 91 follows to shave pavement surface 10 and provide a desired groove profile. Removing the bulk of the pavement material with the conical bit 92 decreases wear on flat bit 91, which extends the useful life of flat bit 91. Decreasing the wear of flat bit 91 additionally provides the ability of cutting machine 1 to cut a longer groove before replacing flat bits 91 and reduces shutdown time during maintenance operations.

Figure 13:
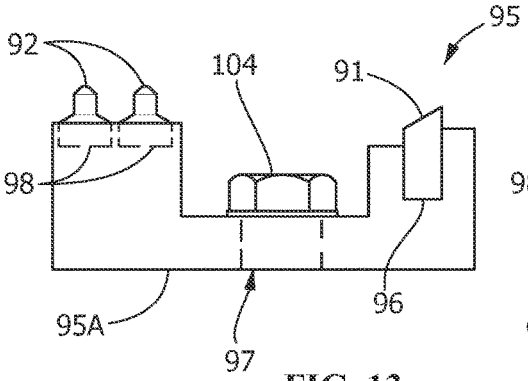
FIG. 13 is a sectional view of a cutting tool with two conical bits and a flat bit, according to an embodiment of the disclosure.
Figure 14:
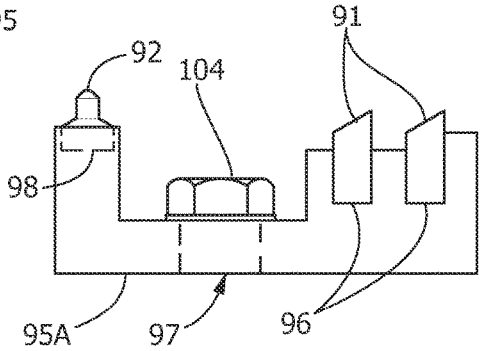
FIG. 14 is a sectional view of a cutting tool with a conical bit and two flat bits, according to an embodiment of the disclosure.

Referring to FIG. 13, in one embodiment, cutting tool 95 receives two conical bits 92 within conical bit inserts 98. Conical bits 92 are positioned on cutting tool 95 such that both conical bits 92 contact pavement surface 10 before flat bit 91. Using two conical bits 92 increases an amount of pavement surface 10 removed by conical bits 92, further decreasing the amount of wear on flat bit 91.

Referring to FIG. 14, in one embodiment, cutting tool 95 receives two flat bits 91 within slots 96. Flat bits 91 are positioned on cutting tool 95 such that conical bit(s) 92 contact the pavement surface 10 prior to flat bits 91. Using two or more flat bits 91 spreads the wear over both flat bits 91, and further decrease the wear of each individual bit 91.

In one embodiment, mounting brackets 90 and cutting tool 95 decrease difficulties and time associated with replacing flat bit 91 and/or conical bit 92 by eliminating the sideways removal process currently used. Cutting tool 95 is detached from mounting bracket 90 by removing the threaded member or similar fastener from threaded recess 93 and hole 97. Cutting tool 95 may be discarded and/or recycled and replaced. The replacement cutting tool 95 is inserted into receiving slot 94 and secured by threaded member 104. Additionally, a vertical extraction/mounting process of cutting tool 95 to mounting bracket 90 allows for an increased concentration of cutting tools 95 on the cutting drum 3. For example a horizontal extraction/mounting process permits a concentration of thirty-six (36) cutting tools 95 having a single flat bit 91 across a 8.5" cutting width, and the vertical extraction/mounting process permits eighty-eight (88) cutting tools 95 having two flat bits 91 across the same 8.5" cutting width.

While the exemplary embodiments illustrated in the figures and described herein are presently preferred, it should be understood that these embodiments are offered by way of example only. Accordingly, the present application is not limited to a particular embodiment, but extends to various modifications that nevertheless fall within the scope of the appended claims. The order or sequence of any processes or method steps may be varied or re-sequenced according to alternative embodiments.

What is claimed is:

1. A cutting tool, comprising:

a saddle portion;

an aperture extending through the saddle portion and aligned with a threaded recess in a mounting bracket; and at least one cutting bit attachment portion;

at least one conical bit and at least one flat bit secured to the at least one cutting bit attachment portion of the cutting tool;

wherein the saddle portion is securable and removable vertically to the mounting bracket via a threaded member insertable through the aperture;

the saddle portion comprising a flat bottom surface insertable into a receiving slot of the mounting bracket; and the aperture extending through the saddle portion is arranged to provide vertical removal of the cutting tool from the mounting bracket and the vertically securable and removable saddle portion provides adjacent mounting of the cutting tool on a cutting drum; and the cutting bit attachment portion arranged and disposed in the saddle portion to contact a pavement surface with the at least one conical bit prior to the at least one flat bit during a rotation of the rotatable cutting head.

2. The cutting tool of claim 1, wherein the at least one cutting bit attachment portion comprises a slot.

3. The cutting tool of claim 2, further comprising a flat bit secured within the slot.

4. The cutting tool of claim 3, wherein the flat bit is welded within the slot.

5. The cutting tool of claim 1, wherein the at least one cutting bit attachment portion comprises at least two slots.

6. The cutting tool of claim 1, wherein the at least one cutting bit attachment portion comprises a slot and a generally circular recess.

7. The cutting tool of claim 6, further comprising a flat bit secured within the slot and a conical bit secured within the generally circular recess.

8. The cutting tool of claim 6, wherein the generally circular recess further comprises semicircular walls for receiving a conical bit and the slot for receiving a flat bit.

9. The cutting tool of claim 8, further comprising a first flat bit secured within the slot and a second flat bit or a conical bit secured within the generally circular recess.

10. The cutting tool of claim 1, wherein the at least one cutting bit attachment portion comprises at least one slot and at least one generally circular recess.

11. The cutting tool of claim 10, further comprising a first flat bit secured within a first slot, a second flat bit secured within a second slot, and a conical bit secured with the generally circular recess.

12. The cutting tool of claim 10, further comprising a first conical bit secured within a first generally circular recess, a second conical bit secured within a second generally circular recess, and a flat bit secured within the slot.

13. A rotatable cutting head, comprising:

a drive shaft connectable to a drive motor;

a drum portion coupled to the drive shaft, the drum portion having a curved outer surface;

a plurality of mounting brackets secured to the curved outer surface; and at least one cutting tool vertically removably secured to at least one of the mounting brackets;

wherein the at least one cutting tool includes a saddle portion and at least one cutting bit attachment portion;

an aperture extending through the saddle portion and aligned with a threaded recess in a mounting bracket;

wherein the saddle portion is securable and removable vertically to the mounting bracket via a threaded member insertable through the aperture;

the saddle portion comprising a flat bottom surface insertable into a receiving slot of the mounting bracket; and wherein the aperture extending through the saddle portion is arranged to provide vertical removal of the cutting tool from the mounting bracket and the vertically securable and removable saddle portion provides adjacent mounting of the cutting tool on a cutting drum; and at least one conical bit and at least one flat bit secured to the at least one cutting bit attachment portion of the at least one cutting tool, wherein the at least one cutting tool is arranged and disposed in the mounting bracket to contact a pavement surface with the at least one conical bit prior to the at least one flat bit during a rotation of the rotatable cutting head.

14. The rotatable cutting head of claim 13, wherein the plurality of mounting brackets are secured to the curved outer surface in successive rows.

15. The rotatable cutting head of claim 14, wherein the at least one cutting tool secured to at least one of the mounting brackets generates a grinding pathway.

* * * * *